US005946939A

United States Patent [19]

Matsushima et al.

[11] Patent Number: 5,946,939

[45] Date of Patent: Sep. 7, 1999

[54] REFRIGERATOR AND CONDENSER

[75] Inventors: Hiroaki Matsushima, Ryugasaki; Kazuya Matsuo, Tsukuba; Kazuhiro Endoh, Ibaraki-ken; Hiroshi Iwata, Odawara, all of Japan

[73] Assignee: Hitachi, Ltd., Tokyo, Japan

[21] Appl. No.: 08/921,327

[22] Filed: Aug. 29, 1997

Related U.S. Application Data

[62] Division of application No. 08/686,066, Jul. 24, 1996, Pat. No. 5,694,779.

[30] Foreign Application Priority Data

Jul. 26, 1995 [JP] Japan ..... 7-190733

[51] Int. Cl.[6] ..... F25B 39/04

[52] U.S. Cl. ..... 62/507; 165/170

[58] Field of Search ..... 62/114, 506, 507; 165/170, 177

[56] References Cited

U.S. PATENT DOCUMENTS

| | | | |
|---|---|---|---|
| 1,622,376 | 3/1927 | Davenport | 165/177 |
| 2,064,141 | 12/1936 | Askin | 165/170 |
| 2,068,891 | 1/1937 | Scholl . | |
| 2,292,033 | 8/1942 | Atchison | 165/170 |
| 2,626,130 | 1/1953 | Raskin | 165/177 |
| 2,768,508 | 10/1956 | Guyton | 165/177 |
| 4,044,570 | 8/1977 | Ono et al. . | |
| 4,089,324 | 5/1978 | Tjaden | 165/170 |
| 4,344,296 | 8/1982 | Staples . | |
| 4,383,421 | 5/1983 | Quesnoit . | |
| 4,646,533 | 3/1987 | Morita et al. . | |
| 4,757,693 | 7/1988 | Charriau et al. . | |
| 5,359,863 | 11/1994 | Lewis . | |
| 5,359,989 | 11/1994 | Chase et al. | 126/110 R |

FOREIGN PATENT DOCUMENTS

| | | |
|---|---|---|
| 541157 | 5/1993 | European Pat. Off. . |
| 7226222 | 2/1974 | France . |
| 4315924 | 11/1994 | Germany . |
| 9408809 | 4/1994 | WIPO . |

*Primary Examiner*—William Doerrler
*Attorney, Agent, or Firm*—Antonelli, Terry, Stout & Kraus, LLP

[57] ABSTRACT

In a refrigerator, an intermediate heat exchanger as an evaporator in the refrigeration cycle 11 in which a flammable refrigerant is sealed is provided inside of a heat insulating material. A heat transferring device is provided between the intermediate heat exchanger and a heat exchanger for cooling. At the time of stop and occurrence of the refrigerant leakage, the refrigerant inside of the intermediate heat exchanger is recovered into the condenser or into the refrigerant recovery cylinder so that even if the refrigerant leaks out, a leaked amount of the refrigerant into the refrigerator is reduced.

4 Claims, 8 Drawing Sheets

REFRIGERATOR AND CONDENSER

This is a division of application Ser. No. 08/686,066, filed Jul. 24, 1996, now U.S. Pat. 5,694,779.

BACKGROUND OF THE INVENTION

The present invention relates to a refrigerator, and more particularly to a refrigerator using a flammable refrigerant, and a condenser.

DESCRIPTION OF THE PRIOR ART

In recent years, since refrigerants which contain chlorine atoms, such as a refrigerant CFC (chlorofluorocarbon)-12 and HCFC (hydrochlorofluorocarbon)-22, which have been used in the refrigeration cycle, are now regulated for the protection of the ozone layer, a need has arisen to replace these refrigerants with refrigerants that are incapable of destroying the ozone layer. As such refrigerants that are incapable of destroying the ozone layer, HFCs (hydrofluorocarbons) can be considered. For example, the Manual for Reducing Usage of Ozone Layer Destroying Substances, which was published in July 1991 by the Industrial Association for Protective Measure for the Ozone Layer, describes on pages 54 to 56 that HFC-134a is the most possible substance as an alternative refrigerant for CFC-12, which is currently used in refrigerators.

However, HFC-134a has a larger global warming potential than carbon dioxide gas, so HFC-134a is not desirable from the viewpoint of the protection of the global environment.

As an alternative refrigerant which is incapable of destroying the ozone layer and has a low global warming potential, HC (hydrocarbon) type refrigerants can be considered. However, HC type refrigerants are flammable, so it is necessary to ensure safety in using the HC type refrigerants so that fire and explosion will not occur even when the refrigerant leaks out in an accidents or the like.

As means for preventing fire and explosion in the case of using a flammable refrigerant in the refrigeration cycle, for example, the Japanese Patent Unexamined Publication No. HEI 7-55298 discloses an air conditioner having a refrigeration cycle wherein contact between sparks at contact points and a flammable refrigerant therearound is prevented by sealing the contact points of the control relays.

However, in the aforementioned prior art, there is a problem in that fire and explosion may occur with an outside ignition source (such as spark generated at a relay contact point in an adjacent device). Further, when the flammable refrigerant leaks out from the refrigeration cycle, almost all the flammable refrigerant will be discharged to the outside. Thus, a problem arises in that the flammable refrigerant is filled in over a wide range so that there is a danger of explosion.

To solve the aforementioned problem in the prior art, an object of the present invention is to provide a refrigerator using a flammable refrigerant, which reduces the leakage amount into the interior of the refrigerator even when the flammable refrigerant leaks out from the refrigeration cycle and which is capable of averting the danger of fire and explosion.

Furthermore, another object of the present invention is to provide a refrigerator wherein the leakage amount of the refrigerant will be small even if the refrigerant leaks out.

Furthermore, another object of the present invention is to provide a refrigerator which, when the flammable refrigerant leaks out, recovers the flammable refrigerant which is held in the inside of the evaporator, piping and the like toward the condenser side in order to reduce the leakage of the flammable refrigerant to avert the danger of fire and explosion.

Furthermore, another object of the present invention is to provide a condenser wherein the refrigerant flow path area is largely reduced even while securing a heat transfer area so as to largely reduce the sealed amount of refrigerant.

According to the present invention, a refrigerator is provided comprising a compressor, a condenser, an expansion device and an evaporator which are functionally connected with each other, and a refrigeration cycle in which a flammable refrigerant is sealed, characterized in that provided is heat transfer means for transferring heat obtained from a heat exchanger for cooling air in a compartment to the evaporator.

According to the present invention, a refrigerator is provided comprising a compressor, a condenser, an expansion device and an evaporator which are functionally connected to each other, and a refrigeration cycle in which a flammable refrigerant is sealed, characterized in that the evaporator is embedded in a heat insulation material and provided is heat transferring means for transferring heat obtained from a heat exchanger for cooling air in a compartment to the evaporator embedded in the heat insulating material.

The aforementioned heat transferring means is constituted by a thermosiphone. Furthermore, the aforementioned heat transferring means may be constituted by an antifreezing solution circulation system in which the antifreezing solution is circulated.

Furthermore, according to the present invention, a refrigerator is provided comprising a compressor, a condenser, an expansion device and an evaporator which are functionally connected to each other, and a refrigeration cycle in which a flammable refrigerant is sealed, characterized in that the evaporator is constituted by fins provided on a cooling surface of a compartment and a flow path for flammable refrigerant formed on a rear surface of the member opposite to the compartment, and the compartment is cooled via the fins and the cooling surface.

Furthermore, according to the present invention, a refrigerator is provided comprising a compressor, a condenser, an expansion device and an evaporator which are functionally connected to each other, and a refrigeration cycle in which a flammable refrigerant is sealed, characterized in that provided are shut off means for controlling the flow of the flammable refrigerant flowing from the condenser to the expansion device, and checking means for preventing the flammable refrigerant in the compressor from reversely flowing to the evaporator.

Furthermore, according to the present invention, a refrigerator is provided comprising a compressor, a condenser, an expansion device and an evaporator which are functionally connected to each other, and a refrigeration cycle in which a flammable refrigerant is sealed, characterized in that the refrigeration cycle is structured so that the flammable refrigerant held in the evaporator is recovered into the condenser or a refrigerant cylinder.

Further, according to the present invention, a refrigerator is provided comprising a compressor, a condenser, an expansion device and an evaporator which are functionally connected to each other, and a refrigeration cycle in which a flammable refrigerant is sealed, characterized in that refrigerant leakage detecting means for detecting leakage of the flammable refrigerant to a compartment or the outside is provided and the refrigeration cycle is structured so that at least the flammable refrigerant held in the evaporator is recovered into the condenser or a refrigerant cylinder when the refrigerant leakage detecting means detects leakage of the flammable refrigerant.

Furthermore, according to the present invention, a refrigerator is provided comprising a compressor, a condenser, an expansion device and an evaporator which are functionally connected to each other, and a refrigeration cycle in which a flammable refrigerant is sealed, characterized in that provided are shut off means for controlling the flow of the flammable refrigerant that flows from the condenser to the expansion device, checking means for preventing the flammable refrigerant in the condenser from reversely flowing to the evaporator, refrigerant leakage detecting means for detecting leakage of the flammable refrigerant to a compartment or the outside, and a controller for controlling so that when the refrigerant leakage detecting means detects leakage of the flammable refrigerant, the shut off means is closed and operation of the compressor is stopped after a predetermined time is lapsed from the closure of the shut off means and at least flammable refrigerant held in the evaporator is recovered into the condenser or into a refrigerant recovery cylinder.

Furthermore, according to the present invention, a refrigerator is provided comprising a compressor, a condenser, an expansion device and an evaporator which are functionally connected to each other, and a refrigeration cycle in which a flammable refrigerant is sealed, characterized in that refrigerant leakage detecting means is provided for detecting leakage of the flammable refrigerant into a compartment or to the outside, and a refrigerant leakage display is provided for displaying the leakage of flammable refrigerant which is detected by the refrigerant leakage detecting means.

Furthermore, according to the present invention, a refrigerator is provided comprising a compressor, a condenser, an expansion device and an evaporator which are functionally connected to each other, and a refrigeration cycle in which a flammable refrigerant is sealed, characterized in that shut off means for controlling the flow of the flammable refrigerant flowing from the condenser to the expansion device, and checking means for preventing the flammable refrigerant in the compressor from reversely flowing to the evaporator are provided, and a controller is also provided for controlling to stop the operation of the compressor after a predetermined time is lapsed from the closure of the shut off means.

Furthermore, according to the present invention, a refrigerator is provided comprising a compressor, a condenser, an expansion device and an evaporator which are functionally connected to each other, and a refrigeration cycle in which a flammable refrigerant is sealed, characterized in that electric parts which serve as ignition sources are accommodated in a sealed vessel, and the sealed vessel is set in the vicinity of the top part of the refrigerator.

Furthermore, according to the present invention, a refrigerator is provided comprising a compressor, a condenser, an expansion device and an evaporator which are functionally connected to each other, and a refrigeration cycle in which a flammable refrigerant is sealed, characterized in that the refrigeration cycle performs defrosting operation.

Furthermore, according to the present invention, a refrigerator is provided comprising a compressor, a condenser, an expansion device and an evaporator which are functionally connected to each other, and a refrigeration cycle in which a flammable refrigerant is sealed, characterized in that a fan set in the compartment has an explosion-proof construction.

Furthermore, according to the present invention, a refrigerator is provided comprising a compressor, a condenser, an expansion device and, an evaporator which are functionally connected to each other, and a refrigeration cycle in which a flammable refrigerant is sealed, characterized in that the condenser has an inlet for refrigerant, an outlet for refrigerant, a refrigerant path for connecting the inlet to the outlet, and fins for promoting cooling of the refrigerant in the refrigerant path, and the refrigerant path is formed by two curved surfaces of two different kinds of curvatures (one of them includes an infinite curvature).

Furthermore, according to the present invention, a condenser is provided which has an inlet for refrigerant and an outlet for refrigerant, a refrigerant path for connecting the inlet to the outlet, and fins for promoting cooling of the refrigerant in the refrigerant path, and the refrigerant path is formed by two curved surfaces of two different kinds of curvatures (one of them includes an infinite curvature). The refrigerant path is formed by brazing together two metal plates which respectively have grooves of different curvatures. In the condenser, the refrigerant path has a cross section reduced toward the outlet. The refrigerant path of the condenser has a changing curvature in the flow direction of the refrigerant so that the cross section of the path is reduced toward the outlet.

In the aforementioned structure, when a flammable refrigerant such as a mixture of propane and isopropane, which poses no problem in terms of the protection of the global environment, is used in the refrigeration cycle of the refrigerator, the direct infiltration of the flammable refrigerant into the compartment is prevented even when the flammable refrigerant leaks out the evaporator or piping, with the result that the danger of fire and explosion of the refrigerator can be avoided.

Further, in the aforementioned structure, the flammable refrigerant which is held, for example inside of the evaporator or the like, can be recovered into the condenser or into the refrigerant recycling cylinder. Consequently, when a flammable refrigerant such as a mixture of propane and isopropane, which pose no problem in terms of the protection of the global environment, is used, almost all the flammable refrigerant can be recovered into the condenser or into the refrigerant recycling cylinder, even when the flammable refrigerant leaks out the evaporator or the like, and the leaked amount of the flammable refrigerant can be reduced as much as possible, and the danger of fire and explosion of the refrigerator can be avoided.

Further, in the aforementioned structure, the evaporator is embedded in a heat insulating material. Consequently, when the flammable refrigerant such as a mixture of propane and isopropane, which pose no problem in terms of the protection of the global environment, is used, the intrusion of the flammable refrigerant into the compartment can be avoided even when the flammable refrigerant leaks out the evaporator. As a consequence, the danger of fire and explosion of the refrigerator can be avoided.

Further, in the aforementioned structure, the installation place for the evaporator can be arbitrarily selected. For example, when the evaporator is installed outside of the compartment, the direct infiltration of the flammable refrigerant into the compartment can be prevented even when the flammable refrigerant leaks out the evaporator. As a consequence, the danger of fire and explosion of the refrigerator can be avoided.

Further, in the aforementioned structure, the area of the refrigerant path can be largely reduced even while securing a heat transferring area, with the result that a condenser can be realized wherein the sealed amount of refrigerant is largely reduced.

DESCRIPTION OF THE PREFERRED EMBODIMENTS

The present invention will be described by referring to the accompanying drawings.

Figure 1:
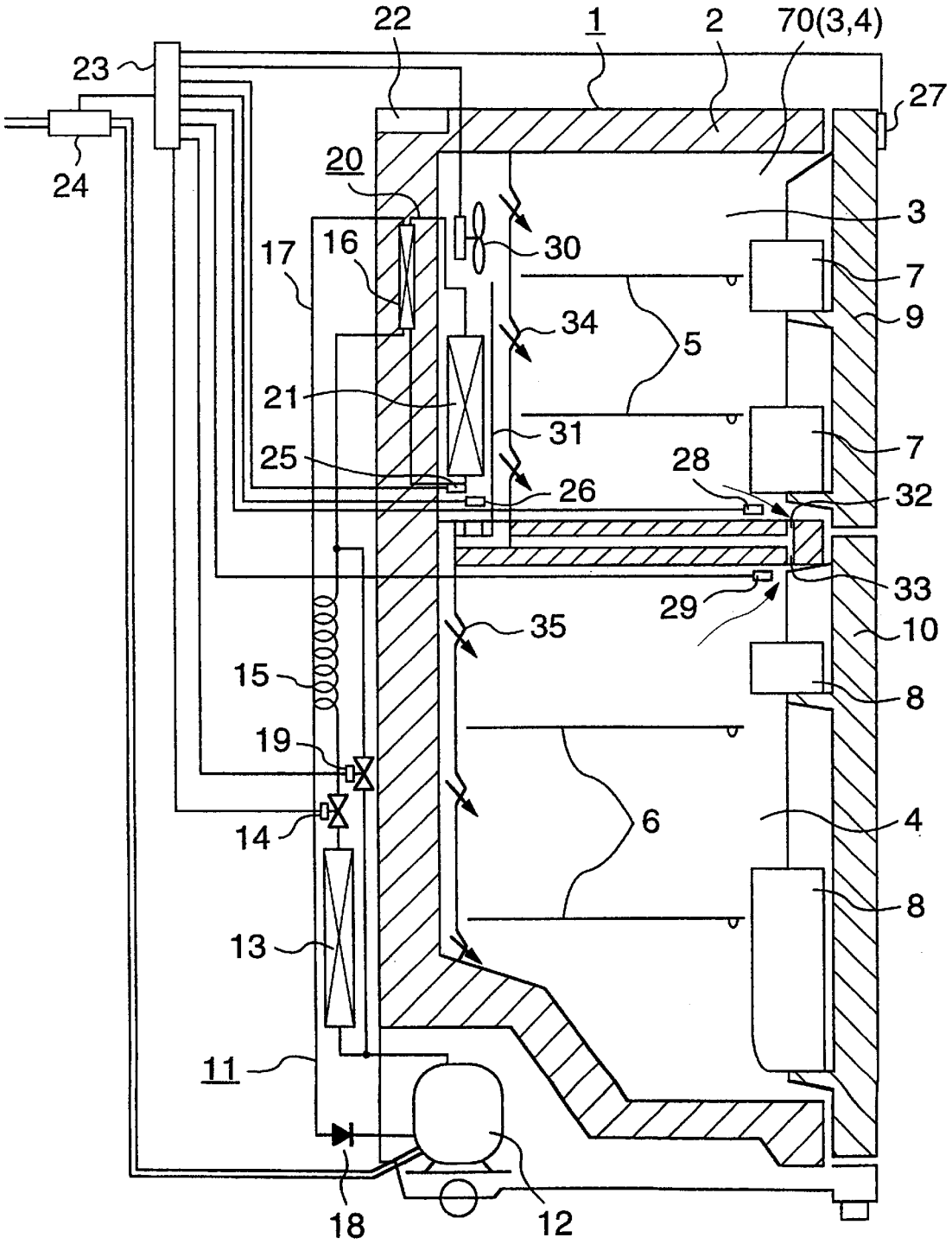
FIG. 1 is a structural view of a first embodiment of a refrigerator according to the present invention.
Figure 2A:
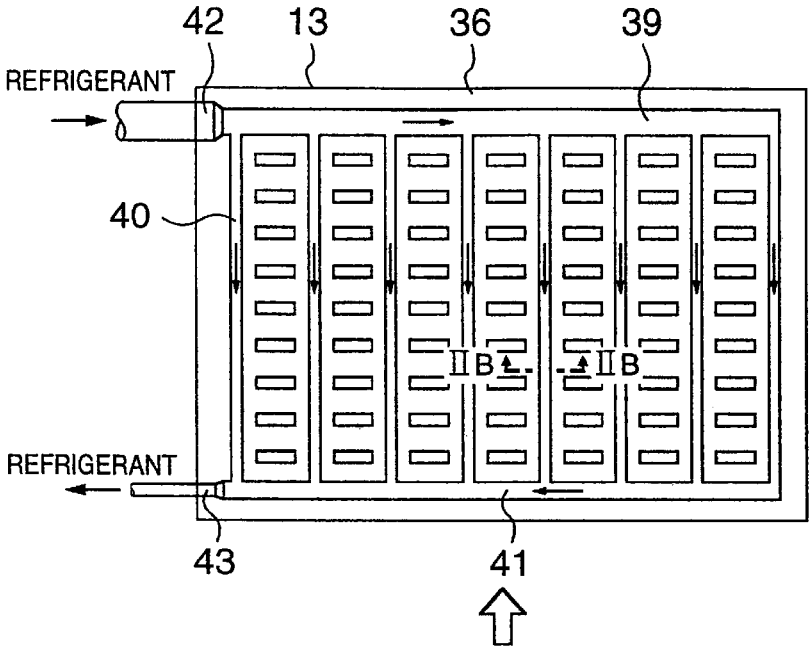
FIG. 2A is a structural view showing a first embodiment of a condenser according to the present invention.
Figure 2B:
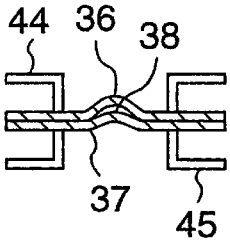
FIG. 2B is a sectional view taken along line IIB—IIB in FIG. 2A.
Figure 3A:
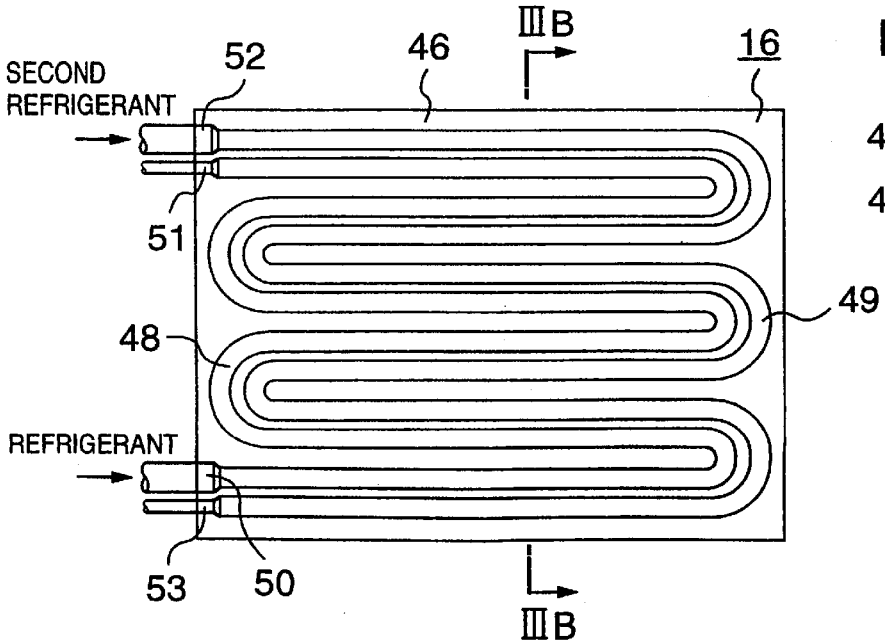
FIG. 3A is a structural view showing one embodiment of an intermediate heat exchanger according to the present invention.
Figure 3B:
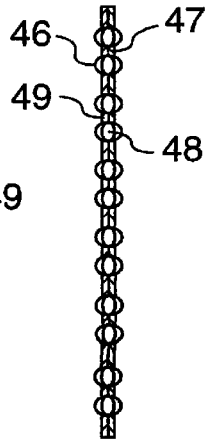
FIG. 3B is a sectional view taken along line IIIB—IIIB in FIG. 3A.

A first embodiment of a refrigerator according to the present invention, a first embodiment of a condenser and an embodiment of an intermediate heat exchanger are explained by referring to FIGS. 1 through 3. Reference numeral 1 denotes a main body of a refrigerator. In the main body of the refrigerator 1, an inside compartment 70 is covered with a heat insulating material 2 so that the compartment 70 is partitioned into a freezing compartment 3 and a refrigerating compartment 4. In addition, the freezing compartment 3 has partition shelves 5 and a freezing compartment door 9 having door pockets 7 for containing small packages of food. In addition, the refrigerating compartment 4 has partition shelves 6 and a refrigerating compartment door 10 having door pockets 8 for containing small packages of food.

Further, to cool the compartment 70 inside of the main body 1 of the refrigerator, there are provided a refrigeration cycle 11 and a heat transferring device 20 which is constituted by a thermosiphone for moving heat (heat conveying or heat conduction) between an intermediate heat exchanger 16, which is embedded in a heat insulating material 2, and a heat exchanger for cooling 21, which is set in the vicinity of a rear wall of the freezing compartment 3. The refrigeration cycle 11 comprises a compressor 12 for raising the temperature and the pressure of the flammable refrigerant to a high level, a condenser 13 for condensing (liquefying) the flammable refrigerant through heat exchange with air which flows therearound, a shut off valve 14, an expansion device (expansion device) 15 formed by a capillary tube or the like and for reducing the pressure of the flammable refrigerant while heat exchanging with the flammable refrigerant in a return pipe 17, an intermediate heat exchanger 16 which is set inside the heat insulating material 2 and which also serves as an evaporator for the refrigeration cycle (for cooling a second refrigerant to evaporate the flammable refrigerant), a return piping 17 which is set so as to be able to heat exchange with device, a check valve 18, a condenser 13, a shut off valve 14, and a shut off valve 19 for defrosting for opening and closing a circuit which bypasses the expansion device 15 (capillary tubes or the like). Inside of the refrigeration cycle 11, a flammable refrigerant (such as a mixed refrigerant of propane and isopropane) is sealed. In particular, the boiling point of the flammable refrigerant will be approximately that of the conventional CFC-12 when a refrigerant formed of a mixture of propane and isopropane is used as the flammable refrigerant, particularly when used is a mixed refrigerant of which mixture rate of propane and isopropane is about 40:60 in mass %, the cooling capacity will be approximately that of the conventional CFC-12. Incidentally, the reason why the intermediate heat exchanger 16 which also serves as an evaporator is set inside of the heat insulating material 2 is that the flammable refrigerant will be blocked out by the wall of the compartment 70 so that the flammable refrigerant will not intrude into the compartment 70 even if the flammable refrigerant leaks out the evaporator. Therefore, it is not necessary to set (embed) the evaporator inside of the heat insulating material 2 when the refrigerator is constituted so that the flammable refrigerant cannot intrude into the compartment 70.

On the other hand, inside of the heat transfer device 20 of a thermosiphone or the like, a carbonic acid gas which is an inflammable refrigerant is sealed as a secondary refrigerant, and a wick is provided inside of the piping.

An electric part box 22 is provided on a top of the main body 1 of the refrigerator, in which a controller 23 and a driving device 24 for the compressor are installed in a sealed manner. The controller 23 incorporates detected values from a refrigerant leakage detector 26, a temperature detector 25 for the heat exchanger for cooling, a temperature detector 28 for the freezing compartment and a temperature detector 29 for the refrigerating compartment and controls the driving device 24 for the compressor, the shut off valve 14, the shut off valve 19 for defrosting and a damper (not shown) or the like. In addition, the driving device 24 for the compressor turns on and off the compressor 12 and the fan 30. Consequently, the aforementioned electric part box 22 sealingly accommodates the electric parts (controller 23 and driving device 24 for the compressor) and is provided on the top of the main body 1 of the refrigerator. Consequently, even if leakage of the flammable refrigerant occurs at the outside, the propane and isopropane, which are heavier than air, will be collected at the lower part of the main body 1 of the refrigerator, so that the electric parts will be prevented from serving as an ignition source. The refrigerant leakage detector 26 detects the leaked flammable refrigerant collected at the lower part of the freezing compartment 3. The temperature detector 25 for the heat exchanger for cooling detects (measures) the temperature of the heat exchanger for cooling 21. In addition, the temperature detector 28 of the freezing compartment and the detector 29 of the refrigerating compartment respectively serve to detect (measure) the temperature of the freezing compartment 3 and the refrigerating compartment 4.

The refrigerant leakage display 27 displays the leakage of the refrigerant on the front surface of the refrigerator 1 when the refrigerant leakage detector 26 detects leakage of the flammable refrigerant. The fan 30 is an explosion-proof construction. The fan 30 serves to allow air cooled by the heat exchanger for cooling 21 to flow along an air path 31. The air path 31 includes a suction port 32 for the freezing compartment, a suction port 33 for the refrigerating compartment, a blow out port 34 for the freezing compartment and a blow out port 35 for the refrigerating compartment.

As shown in FIG. 2, the condenser 13 comprises a refrigerant path 38 which is formed by brazing together two metal plates 36 and 37 respectively having grooves of different curvatures or depths, an inlet header 39, a condensing portion 40, an outlet header 41, an inlet connecting part 42 and an outlet connecting part 43 expanded for connection with the refrigeration cycle 11, and heat transfer promotion fins 44 and 45 cut and bent from the metal plates 36, 37 in opposite directions.

In the intermediate heat exchanger 16, a refrigerant path 48 and a secondary refrigerant path 49 are formed in an independent manner by brazing together two metal plates 46 and 47 as shown in FIG. 3. The refrigerant path 48 is provided with an inlet connecting part 50 and an outlet connecting part 51 while the secondary refrigerant flow path 49 is provided with an inlet connecting part 52 and an outlet connecting part 53.

Operation of the refrigerator will be described. When the temperature detected by the temperature detector 28 for the freezing compartment becomes equal to or greater than a first set temperature $Tf_1$ for the freezing compartment, or when the temperature detected by the temperature detector 29 for the refrigerating compartment becomes equal to the first set temperature $Tc_1$ for the refrigerating compartment, the shut off valve 14 is opened by the controller 23 and the compressor 12 and the fan 30 are driven via the driving device 24 for the compressor. The flammable refrigerant, whose temperature and pressure have been raised to a high level by the compressor 12, is fed to the condenser 13. As shown in FIG. 2, the flammable refrigerant which has entered into the inlet connecting part 42 for the condenser 13 flows through the condensing part 40, which is separated into a plurality of parts from the inlet header 36, and flows in a downward direction while exchanging heat with air that flows around the condenser 13, to be condensed so that the flammable refrigerant flows together again at the outlet header 41 and flows out as a liquid-like flammable refrigerant from the outlet connecting part 43.

Thereafter, the liquid-like flammable refrigerant which has flowed out of the condenser 13 passes through the shut off valve 14 and exchanges heat with the flammable refrigerant in the return piping 17 at the expansion device 15 (capillary tubes or the like), its pressure is reduced, and the flammable refrigerant is sent to the intermediate heat exchanger 16. Flammable refrigerant in a mixed state of gas and liquid with a low temperature and a low pressure that has been sent from the expansion device 15 flows through the refrigerant path 48 in the intermediate heat exchanger 16, and cools the secondary refrigerant which flows through the refrigerant path 49 via metal plates 46 and 47 and is evaporated. The evaporated refrigerant exchanges heat with the expansion device 15 (capillary tubes or the like) in the return piping 17 and passes through the check valve 18 and returns to the compressor 12.

The reason why the refrigerant in the return piping 17 is allowed to heat exchange with the refrigerant in the expansion device 15 is to avoid the following problems. The temperature of the refrigerant in the return piping 17 is low (sometimes −18° C.). Thus when the refrigerant is fed to the compressor, the total efficiency is reduced, and dew is deposited on the return piping 17. In particular, the total efficiency is raised by raising the temperature of the liquid refrigerant in the expansion device 15.

Meanwhile, the secondary refrigerant which has been cooled by the flammable refrigerant at the intermediate heat exchanger 16 is condensed and falls down due to gravity. The secondary refrigerant is sent to the heat exchanger for cooling 21 to exchange heat with air which is fed by the fan 30 and is evaporated. Thus, after evaporation, the secondary refrigerant returns to the intermediate heat exchanger 16 again. Thus, a heat transferring device 20 constituted by thermosiphone is established. Air which has been cooled by the heat exchanger 21 for cooling is blown by the fan 30 to the compartment of which temperature is higher than the predetermined temperature. Specifically, when the temperature detected by the temperature detector 28 for the freezing compartment 3 is higher than the first set temperature $Tf_1$ thereof, the air is blown into the freezing compartment 3 from the blow out port 34 or when the temperature detected by the temperature detector 29 for the refrigerating compartment 4 is higher than the first set temperature $Tc_1$ thereof, the air is blown into the refrigerating compartment 4 from the blow out port 35 by changing over the damper (not shown). When the detected temperature of the temperature detector 28 for the freezing compartment or of the temperature detector 29 for the refrigerating compartment becomes equal to or less than the second set temperature $Tf_2$ for the freezing compartment and the second set temperature $Tc_2$ for the refrigerating compartment, the fan 30 is stopped by the controller 23 and the shut off valve 14 is closed. The compressor 12 continues to be operated during a first set time period of $t_1$. However, since the flammable refrigerant is not being supplied to the intermediate heat exchanger 16, the pressure is lowered and the collected liquid-like flammable refrigerant is evaporated, so that the refrigerant is sent from the compressor 12 to the condenser 13. Thereafter, the refrigerant is condensed and collected in the condenser as liquid flammable refrigerant. After this, the operation of the compressor 12 is stopped.

The controller 23 monitors the added operation time of the refrigeration cycle 11 to perform control so that an operation for removing frost is performed when the added operation time exceeds a second set time $t_2$. In other words, when the added operation time exceeds the second set time $t_2$, the compressor 19 is driven by the controller 23, and the shut off valve for defrosting is opened. The flammable refrigerant, whose temperature and pressure have risen to a high level, passes through the shut off valve 19 for defrosting to be sent to the intermediate heat exchanger 16 in a high temperature state. The flammable refrigerant, whose temperature and pressure have risen to a high level, heats the secondary refrigerant, in the intermediate heat exchanger 16 and part of the flammable refrigerant passes through the return piping 17 after becoming liquid flammable refrigerant. The secondary refrigerant, which has been heated by the intermediate heat exchanger 16, is evaporated and then melts frost which has stuck onto the heat exchanger for cooling 21 to be condensed. The condensed secondary refrigerant returns to the intermediate heat exchanger 16 by means of the wick provided in the piping of the heat transferring device 20 of thermosiphone or the like.

Then when the temperature detected by the temperature detector 25 for the intermediate heat exchanger becomes equal to or greater than the set temperature Tm for the intermediate heat exchanger, the shut off valve 19 is closed by the controller 23, and the compressor 12 is operated during a first set time $t_1$, and frost removal is completed after the flammable refrigerant is recovered from the evaporator.

Further, if the refrigerant leakage detects 26 detects leakage of the flammable refrigerant, regardless of whether the refrigeration cycle 11 is in operation or in stopped operation, the shut off valve 14 is closed by the controller 23 and the compressor 12 is operated during a first set time of $t_1$. At the same time, the refrigerant leakage display 27 displays occurrence of leakage of the flammable refrigerant. After the compressor 12 is operated during the first set time $t_1$ and the flammable refrigerant in the evaporator is recovered, the refrigeration cycle 11 becomes in a stopped condition regardless of the detected temperature of the temperature detector 28 for the freezing compartment and the temperature detector 29 for the refrigerating compartment.

As described above, in the embodiment, parts of the refrigeration cycle 11 which exist inside of the main body 1 of the refrigerator are only connecting pipes and the evaporator. Since these parts are embedded in the heat insulating material 2, the leakage amount of the flammable refrigerant to the cooling compartment is small, because even if the flammable refrigerant leaks out the evaporator in some accident, the flammable refrigerant leaks into the inside of the heat insulating material 2, which is sealed off. In addition, because carbonic acid gas is used as a secondary refrigerant in the heat transferring device, there is little danger even if the secondary refrigerant leaks.

Furthermore, if the refrigerant leakage detector detects flammable refrigerant which has leaked into, for example, the compartment 70, particularly in the freezing compartment 3, it is possible to arouse user's attention by displaying the leakage of the flammable refrigerant on the refrigerant leakage display 27, which is provided on the surface of the main body of the refrigerator 1. In addition, in a stopped operation, the flammable refrigerant within the refrigeration cycle is collected between the check valve 18, which faces the outside surface, and the shut off valve 14, so that the flammable refrigerant hardly leaks out even at a time when breakage in the piping inside of the main body 1 of the refrigerator is occurred. Further, even when the flammable refrigerant leaks out to the inside (for example, to the compartment 70) of the refrigerator 1 for some reason, the flammable refrigerant leakage detector 26 detects the leakage of the flammable refrigerant and the flammable refrigerant is recovered to the side of the condenser 13, so that the amount of refrigerant that leaks out to the inside of the main body of the refrigerator is small.

Furthermore, since the refrigerant path 38 of the condenser 13, which requires the largest amount of the flammable refrigerant during operation, uses a gap between two plates, the heat transferring area can be secured, the area of the refrigerant path can be largely reduced, and further the sealed-in amount of the flammable refrigerant can be largely reduced. Moreover, by making the flammable refrigerant flow from up to down, it is possible to reduce a collected amount of the liquid flammable refrigerant and a sealed-in amount of the flammable refrigerant.

Further, also in the case where a non-azeotropic flammable refrigerant such as a mixture of propane and isopropane is used as a flammable refrigerant, a temperature gradient peculiar to the non-azeotrope can be efficiently used by allowing the flammable refrigerant in the condenser 13 to flow from above to below and by allowing an air stream in the condenser to flow from below to above, so that the power consumption of the refrigerator can be reduced.

Further, frost is removed in the refrigeration cycle and the fan is formed of an explosion-proof construction, so that ignition sources inside of the refrigerator can be removed. Further, by sealing off electric parts (the controller 23, compressor driving device 25 and the like) in the electric parts box on the top part of the refrigerator, they cannot be an ignition source to the refrigerant, because propane and isopropane are both heavier than air and are collected at the lower part of the refrigerator even if the flammable refrigerant leaks out to the outside.

Figure 4:
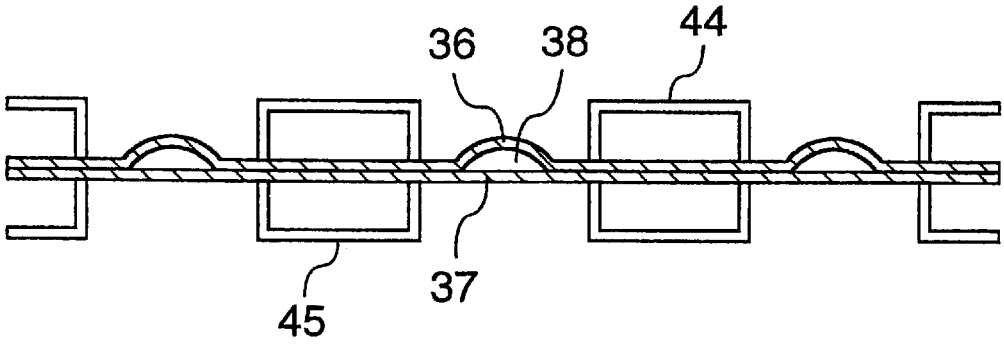
FIG. 4 is a partial sectional view which is the same as FIG. 2 showing a modified form of the first embodiment of the condenser of the present invention.

Incidentally, in the aforementioned description there is described an embodiment in which the evaporator is embedded inside of the heat insulating material 2. However, the evaporator need not necessarily be embedded inside of the heat insulating material. The embodiment may be formed with a structure in which the flammable refrigerant that has leaked out the evaporator is prevented from intruding into the compartment 70. Further, with respect to the condenser 13, there is described an embodiment in which two metal plates provided with grooves having different curvatures or depths are laminated to each other, as shown in FIG. 2. As shown in FIG. 4, even when one of the metal plates is formed of a planar plate having an infinite size of curvature, the embodiment can be embodied even though the sealed amount of refrigerant will be somewhat increased. In the case of this embodiment, the working of providing a groove in the metal plate is required with respect to one of the metal plates, so that the working can be done easily and the cost thereof can be largely reduced. Furthermore, the condenser 13 may be constituted by a plurality of condensing parts, each of which two metal plates with grooves different curvatures are laminated, connected with each other by pipes. Further, in the refrigerant path 38 of the aforementioned embodiment, the cross section is made smaller toward the outlet of the refrigerant by changing the curvature in the direction of the refrigerant flow path so that the amount of flammable refrigerant which is sealed in is further reduced.

Figure 5:
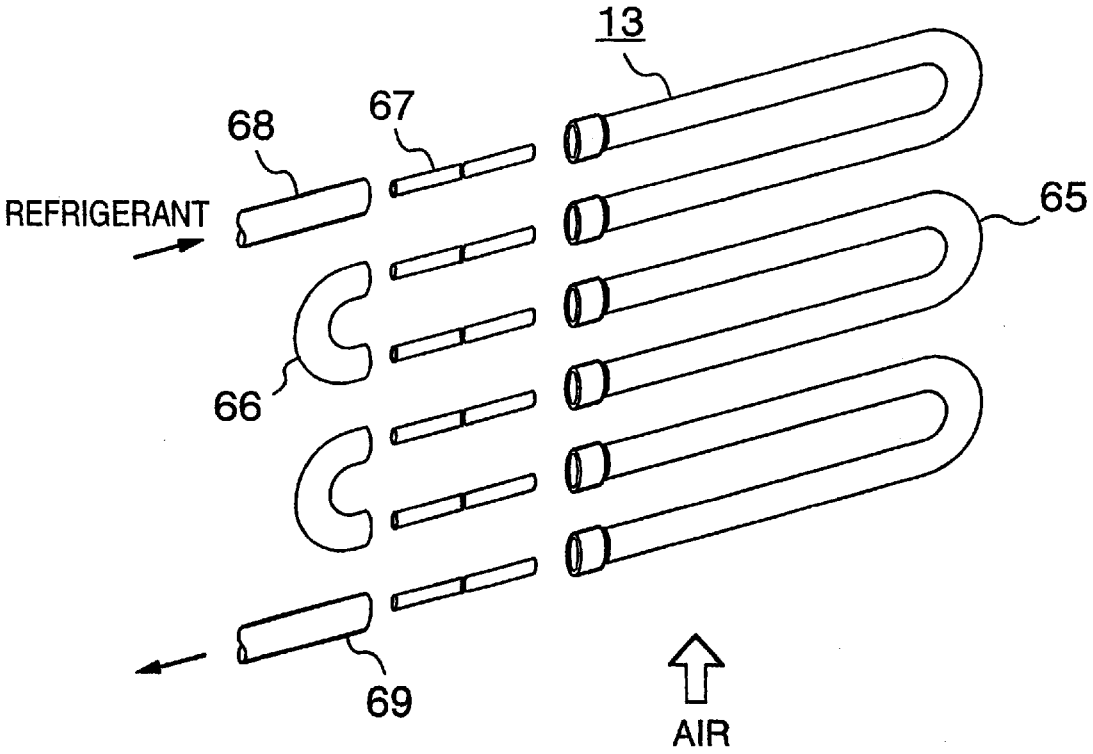
FIG. 5 is a structural view showing a second embodiment of a condenser according to the present invention.

A second embodiment of the condenser 13 will be explained by referring to FIG. 5. In FIG. 5, reference numeral 65 denotes a heat transferring pipe provided with fins (not shown) for enlarging the heat transferring surface. The end of the heat transferring pipe 65 is enlarged so that an inlet connecting pipe 68 provided on the downstream side of the air, an outlet connecting pipe 69 for the condenser provided on the upstream side of the air and bent pipes can be connected. Reference numeral 67 denotes a solid rod which is thinner than the internal diameter of the heat transferring pipe 65 and is inserted into the inside of the heat transferring pipe and fixed in place.

Operation of the condenser 13 which is constituted in this manner will be explained. A gas refrigerant having a high temperature and a high pressure is supplied to the condenser 13 from the inlet connecting pipe 68. At this time, since the solid rod 67 is inserted into the inside of the heat transferring pipe 65, the refrigerant flows through a gap between the inside surface of the heat transferring pipe and the external periphery of the solid rod 67 while exchanging heat with the external air, and is discharged from the outlet connecting pipe 69. Meanwhile, air flowing around the periphery of the condenser 13 flows in the direction of the inlet of the condenser from the outlet of the condenser. Therefore, the cross section of the path of the refrigerant in the heat transferring pipe can be reduced in size without reducing the size of the outside area of the heat transferring pipe, and the required amount of refrigerant in the condenser 13 can be reduced. Furthermore, the flow rate of the refrigerant is increased, and the pressure loss is increased. However, the refrigerant has a high pressure, and therefore, the fall in condense temperature due to pressure loss is low. Further, the flow direction of the air is set in the direction from the outlet for the refrigerant to the inlet thereof, so that reduction in the heat transferring performance is hardly present because of the effect of the counter-current. On the contrary, the heat transferring performance is increased by an increase in the flow rate of the refrigerant at the time of the use of a mixed refrigerant, so that a refrigerator whose power consumption is low can be provided.

Further, in the present embodiment, a solid rod with the same external diameter is used, but an effect of reducing the refrigerant amount can be provided by increasing the thickness of the rod toward the outlet, which has a high ratio of liquid refrigerant. Further, the heat transferring pipes 65 may be pipes with different diameters.

Figure 6:
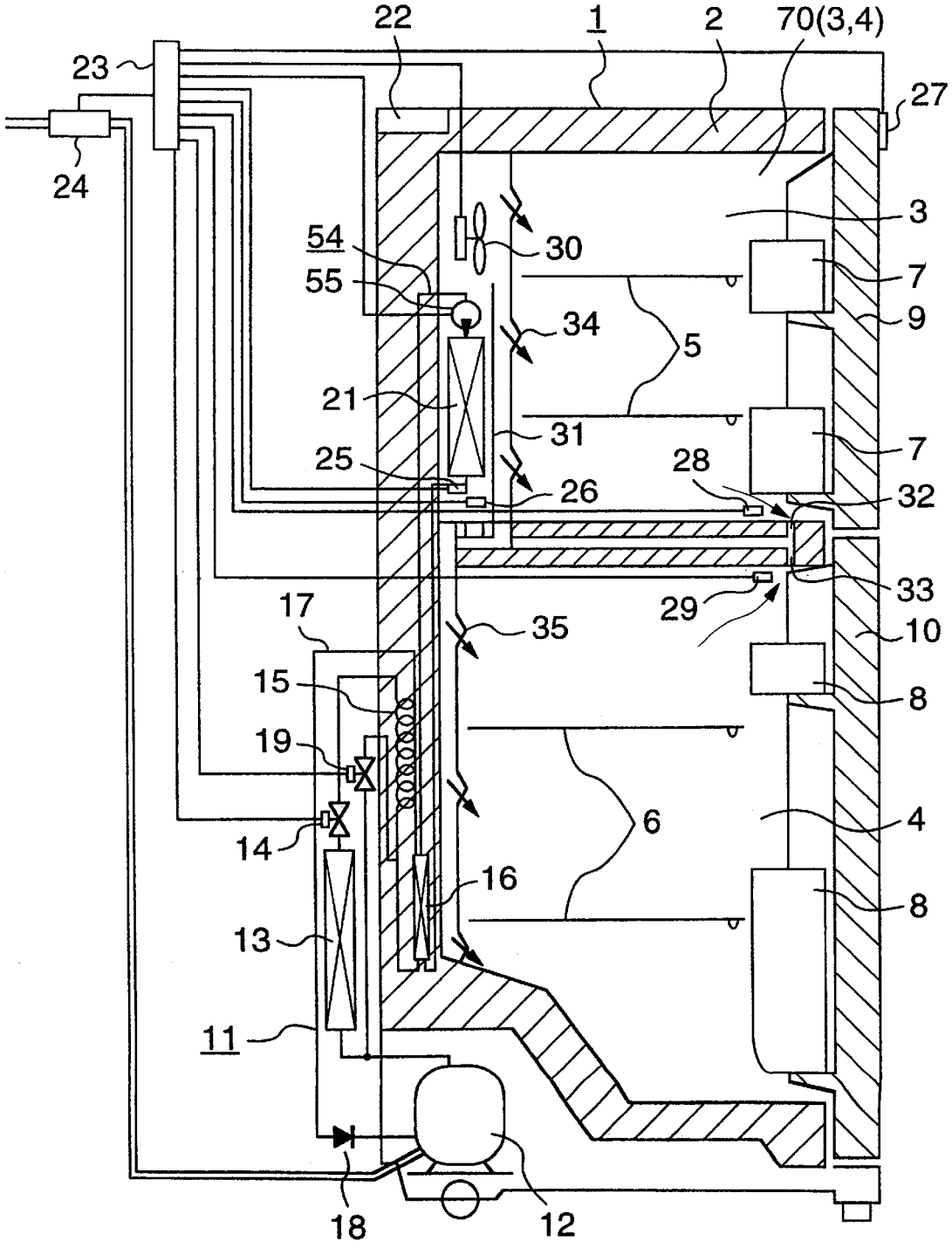
FIG. 6 is a structural view of a second embodiment of a refrigerator according to the present invention.

Next, a second embodiment of the refrigerator will be explained by referring to FIG. 6. In FIG. 6, reference numeral 54 denotes a heat transferring device in which an antifreezing solution is sealed. Reference numeral 55 denotes a liquid pump for circulating the antifreezing solution. The antifreezing solution may be any solution such as ethylenegrlcol or the like which do not freeze in a temperature range of the refrigerator. Incidentally, like numerals in FIG. 6 denote like parts in FIG. 1.

By constituting the refrigerator in this manner, when the compressor 12 and the liquid pump 54 are driven by the controller 23, the temperature of the intermediate heat exchanger 16 is lowered in the refrigeration cycle 11, and the cooled antifreezing solution is sent to the heat exchanger for cooling 21 by the liquid pump. After the solution cools air supplied by the fan 30 in the heat exchanger for cooling 21, it returns to the intermediate heat exchanger 16. Heat transfer is performed. An operation and advantages similar to the those of the first embodiment of the aforementioned refrigerator 1 can be obtained. Further, heat is transferred between the intermediate heat exchanger 16 and the heat exchanger for cooling 21 by the antifreezing solution and the liquid pump 55, so that the limitation on the installation place of the intermediate heat exchanger 16 and the heat exchange for cooling 21 is eliminated. Therefore, the refrigeration cycle 11 can be concentrated in the lower part of the refrigerator, and the refrigerant amount in the refrigeration cycle can be further reduced because the connection piping can be shortened.

Figure 7:
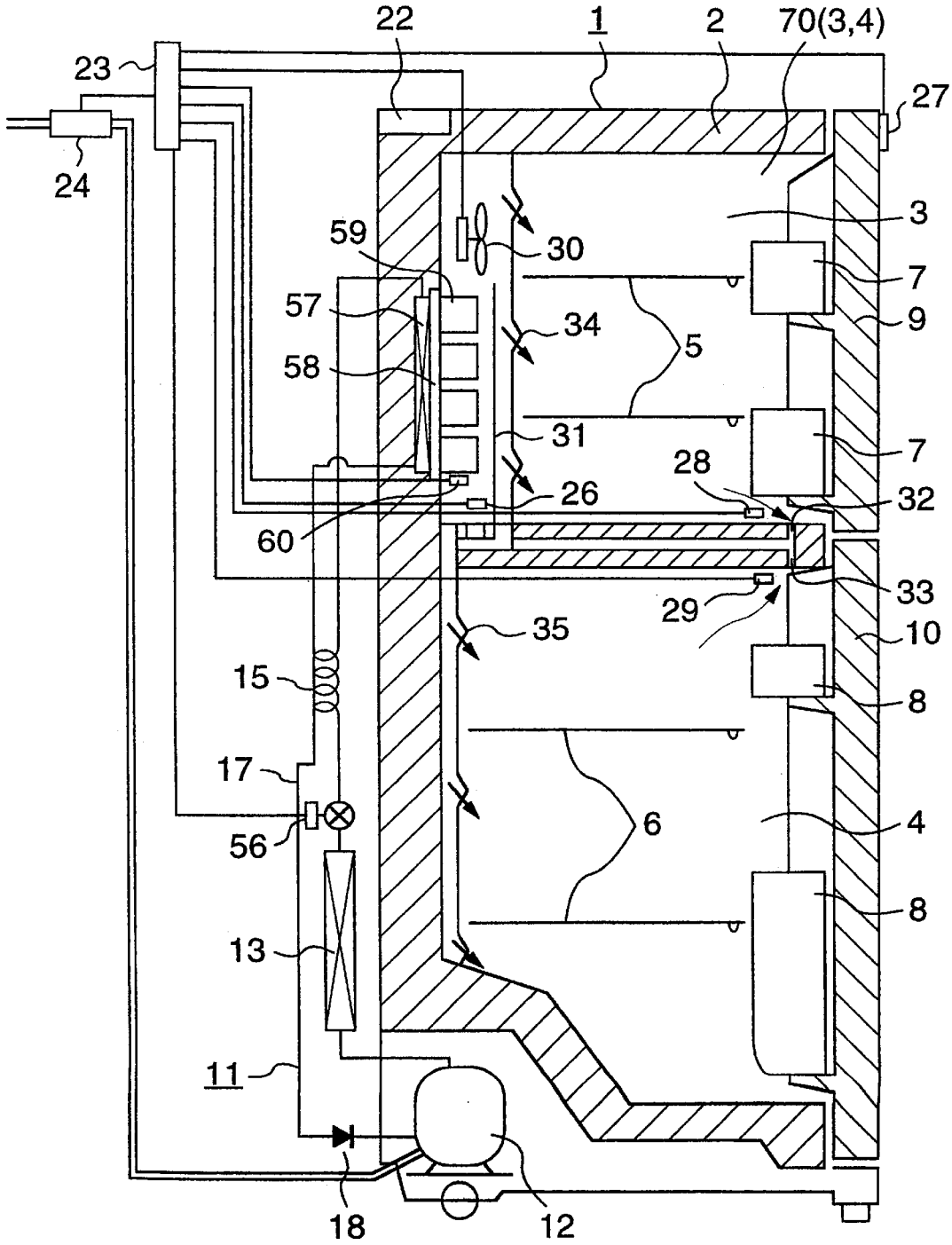
FIG. 7 is a structural view a third embodiment of a refrigerator according to the present invention.
Figure 8:
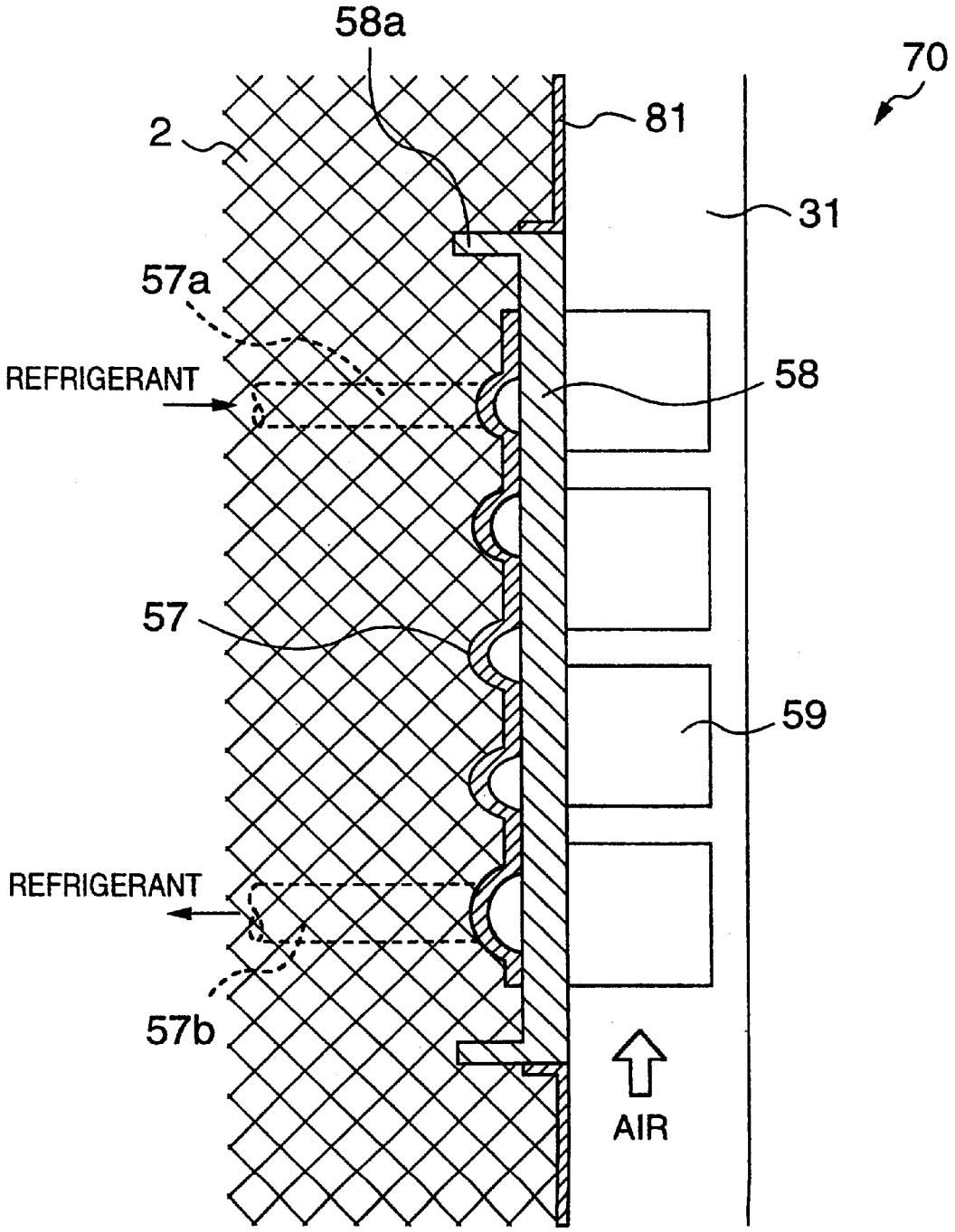
FIG. 8 is a sectional view showing a detailed structure of the evaporator shown in FIG. 7.

A third embodiment of the refrigerator according to the present invention will be explained by referring to FIGS. 7 and 8. In FIGS. 7 and 8, reference numeral 56 denotes a motor driven expansion valve having a function of expansion device. Its degree of opening can be changed by the controller 23. Reference numeral 57 denotes an evaporator in the refrigeration cycle 11. One metal plate is provided with a groove of which cross section is enlarged toward the direction of the outlet for the refrigerant. This metal plate is laminated to a cooling plate 58 which serves as a heat transferring device to form a refrigerant path. An inlet 57*a* for the evaporator and an outlet 57*b* for the evaporator are provided so that the flow of the refrigerant is set opposite to the air flow. Reference numeral 58*a* denotes a projection which is provided on the periphery of the heat radiating plate (cooling plate) 58 so as to enter the heat insulating material 2 and reference numeral 59 denotes cooling fins which serve as a heat exchanger for cooling which is provided on the heat radiating plate (cooling plate) 58. Reference numeral 60 denotes a temperature detector for the cooling fins, which detects the temperature of the cooling fins 59. Reference numeral 81 denotes a wall for forming the compartment 70. Like numerals in FIG. 6 denote like parts in FIG. 1.

Operation of the refrigerator which is constituted in this manner will be explained. As in the first embodiment of the refrigerator 1, when the temperature detected by the temperature detector 28 for the freezing compartment becomes equal to or greater than the first set temperature $Tf_1$ for the freezing compartment, or the temperature detected by the temperature detector 29 for the refrigerating compartment becomes equal to or greater than the first set temperature $Tc_1$ for the refrigerating compartment, the motor-driven expansion valve 56 is controlled to the set opening degree by the controller 23, and the compressor 12 and the fan 30 are driven. After the refrigerant, whose temperature and pressure has been raised to a high level by the compressor 12, is sent to the condenser 13 and is condensed to be the liquid refrigerant, the refrigerant is reduced in pressure by the motor-driven expansion valve 56. Furthermore, the refrigerant is reduced in pressure while exchanging heat with the refrigerant in the return piping 17 at the expansion device 15 of capillary tubes or the like. Then the refrigerant is supplied to the evaporator 57 to cool the cooling plate 58 and to be evaporated. The evaporated refrigerant exchanges heat with the refrigerant in the return piping 17 at the expansion device 15 passes through the check valve 18 and returns to a compressor 12, thereby constituting a refrigeration cycle. Meanwhile, the cooling plate 58, which is cooled by the evaporator 57, cools the air by means of the cooling fins 59. When the temperature detected by the temperature detector 28 for the freezing compartment or by the detector 29 for the refrigerating compartment is higher than the respective set values, for example, when the temperature detected by the detector 28 for the freezing compartment is higher than the first set temperature $Tf_1$, the cooled air is blown by the fan 30 into the freezing compartment from the outlet 34 of the freezing compartment 3 to cool the inside. Here, when the temperature detected by the detector 28 for the freezing compartment or by the detector 29 for the refrigerating compartment becomes equal to or less than the second set temperature $Tf_2$ for the freezing compartment or the second set temperature $Tc_2$ for the refrigerating compartment, the fan 30 is stopped by the controller 23 and the motor-driven expansion valve 56 is completely closed. The operation of the compressor 12 is further continued during the first set time $t_1$. However, since the flammable refrigerant is not supplied to the evaporator 57, the pressure is lowered and the liquid flammable refrigerant which is collected is evaporated and is sent from the compressor 12 to the condenser 13. Thereafter, the flammable refrigerant is condensed and collected in the condenser 3 as a liquid flammable refrigerant. After that, the operation of the compressor 12 is stopped.

Furthermore, if the refrigerant leakage detector 26 detects leakage of the flammable refrigerant, the motor-driven expansion valve 56 is completely closed and the compressor 12 is operated during the first set time $t_1$ irrespective of whether the refrigeration cycle 11 is in operation or stopped. At the same time, the refrigerant leakage display 27 displays that leakage of the flammable refrigerant has occurred. After the compressor 12 is operated during the first set time $t_1$ and the flammable refrigerant in the evaporator 57 is recovered, the refrigeration cycle 11 becomes stopped independent of the temperature detected by the detector 28 for the freezing compartment and by the detector 29 for the refrigerating compartment.

When the operation time of the refrigeration cycle 11 exceeds a third set time t3, the motor-driven expansion valve 56 is completely opened and the compressor 12 is driven by the controller 23 to perform a defrosting operation. The flammable refrigerant, whose temperature and pressure have been raised to a high level by the compressor 12, partially radiates heat at the compressor 12 and is sent to the expansion device 15 of capillary tubes or the like via the motor-driven expansion valve 56. Since the motor-driven expansion valve 56 is completely opened at this time, the pressure reduction is small. The pressure of the flammable refrigerant in the condenser 13 is low and the heat radiation amount in the condenser 13 is small. The flammable refrigerant, whose pressure has been slightly reduced at the expansion device 15 of capillary tubes or the like, is sent to the evaporator 57, and the refrigerant is condensed by melting frost which has stuck to the cooling fins 59 through the cooling plate 58. Then part of the flammable refrigerant becomes liquid refrigerant to return to the compressor 12 via a return piping 17 to perform the operation of removing frost. When the temperature detected by the temperature detector 60 of the cooling fins exceeds the set temperature Tn of the cooling fins, the motor-driven expansion valve 56 is completely closed and the compressor 12 is stopped after the flammable refrigerant in the evaporator 57 is recovered, thereby completing the defrosting operation.

In the third embodiment which has been described above, an advantages similar to those of the first and the second embodiment can be obtained. Further, the secondary refrigerant is not needed, and the heat transferring device can be reduced in size. In addition, the frost-removing shut off valve 19 is not required because of the use of the motor-driven expansion valve 56 of which opening degree is variable, and the refrigeration cycle also can be reduced in size. The same advantages also can be provided when the motor-driven expansion valve 56 is used in the first or the second embodiment. Furthermore, because of the projection 58*a* that is provided on the periphery of the cooling plate (heat radiating plate) 58 and enters the inside of the heat insulating plate 2, leakage of the flammable refrigerant to inside of the main body 1 of the refrigerator never occurs even when the flammable refrigerant leaks out the evaporator 57. In addition, the temperature gradient of the mixed flammable refrigerant at the time of evaporation can be efficiently used by setting the flow of the flammable refrigerant in the evaporator 57 opposite to the air stream, so that the power consumption of the refrigerator can be reduced.

Figure 9:
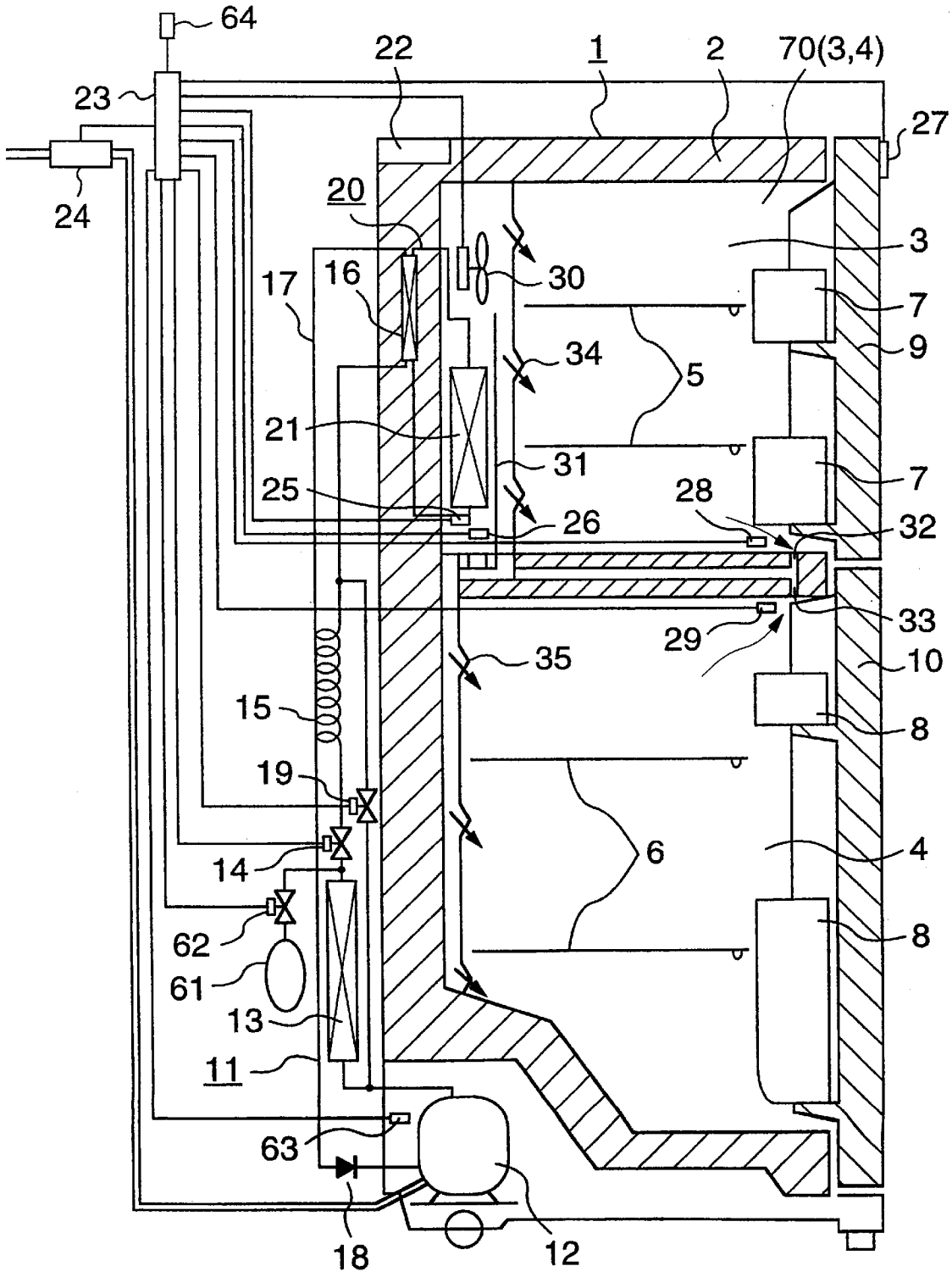
FIG. 9 is a structural view showing a fourth embodiment of a refrigerator according to the present invention.
Figure 10:
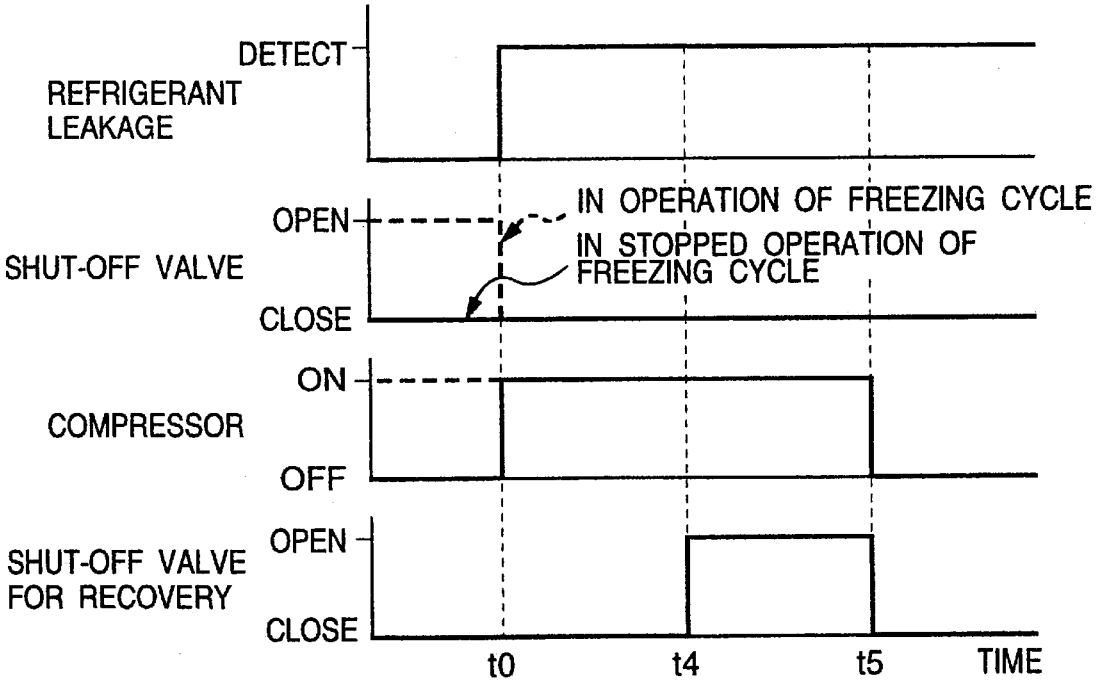
FIG. 10 is a time chart at the time of the detection of leakage of the refrigerant in the refrigerator according to the fourth embodiment.

A fourth embodiment of the refrigerator according to the present invention will be explained by referring to FIGS. 9 and 10. In FIG. 9, reference numeral 61 denotes a refrigerant recovery cylinder which is connected from the outlet of the condenser 13 via a shut off valve for recovery 62 and the inside thereof is substantially vacuum. Reference numeral 63 denotes an outside refrigerant leakage detector, and 64 denotes a refrigerant recovery switch provided on the controller 23. The outside refrigerant leakage detector 63 detects leakage of the refrigerant (flammable refrigerant) to the outside. When the flammable refrigerant is either propane or isopropane and it leaks out to the outside, the refrigerant will be collected at the lower part of the main body 1 of the refrigerator, since propane and isopropane are both heavier than air. Thus it is desirable that the outside refrigerant leakage detector 63 be set in the lower part of the main body 1 of the refrigerator. Incidentally, like numerals in FIGS. 1, 6 and 7 denote like parts.

Operation of the refrigerator which is constituted in the aforementioned manner will be explained. The cooling operation of the refrigerator 1 is the same as the first and the third embodiments. When the refrigerant leakage detector 26 or the outside refrigerant detector 63 detects leakage of the refrigerant (time $t_0$), the controller 23 closes the shut off valve 14 and operates the compressor 12 during a fourth set time (time $t_4$), regardless of whether the refrigeration cycle is in operation or stopped, so that the refrigerant in the refrigeration cycle is recovered into the condenser 13 as a high pressure liquid refrigerant. After the compressor 12 is operated for the fourth set time (time $t_4$), the recovery shut off valve 62 is opened for a fifth set time (time t5) so that the refrigerant which has been collected in the condenser 13 flows into the refrigerant recovery cylinder 61 because of a pressure difference. After the lapse of the fifth set time (time t5), the recovery shut off valve 62 is closed, and the compressor 12 is stopped. Then the recovery operation is stopped. Consequently, an amount of refrigerant which remains in the refrigeration cycle is small, and an amount of refrigerant which leaks out to the outside from the refrigeration cycle is a little. Then, the same operation as at the time of detecting the refrigerant leakage is performed by pressing down the refrigerant recovery switch 64. Consequently, the refrigerant can be recovered without requiring a special procedure even when a need arises to recover the refrigerant at the time of discarding the refrigerator.

In this embodiment, the refrigerant recovery cylinder 61 is connected to the outlet of the condenser 13 of the refrigeration cycle 11. The connection position may be located on the high pressure side from the outlet of the compressor 13 to device (expansion device) 15. In addition, in this embodiment, the refrigerant recovery cylinder which is set in a vacuum state is used. A material which can adsorb HC type refrigerants, such as activated carbon or the like, may be sealed in the refrigerant recovery cylinder. In such a case, the refrigerant recovery rate can be improved by the material.

In the present embodiment, the recovery of the flammable refrigerant will be explained. It is clear that the refrigerant need not necessarily be limited to a flammable refrigerant.

What is claimed is:

1. A condenser comprising an inlet for refrigerant, an outlet for refrigerant, a refrigerant path which communicates from the inlet to said outlet, and cooling promotion fins for promoting cooling of the refrigerant in said refrigerant path, wherein said refrigerant path is formed by two curved surfaces curved in the same direction and having different non-infinite curvatures.

2. A condenser according to claim 1 wherein said refrigerant path is formed by brazing together two metal plates respectively having grooves curved in the same direction and having different non-infinite curvatures.

3. A condenser according to claim 1 wherein said refrigerant path has a cross section which is reduced in size toward the outlet for refrigerant.

4. A refrigerator comprising a compressor, a condenser, an expansion device, and an evaporator which are functionally connected to each other, and a refrigeration cycle in which a flammable refrigerant is sealed, wherein said condenser has an inlet for refrigerant, an outlet for refrigerant, a refrigerant path which communicates from said inlet to said outlet, and cooling promotion fins for promoting cooling of the refrigerant in the refrigerant path, and said refrigerant path is formed by two curved surfaces curved in the same direction and having two different non-infinite kinds of curvatures.

* * * * *